US009251756B2

(12) United States Patent
Choi et al.

(10) Patent No.: US 9,251,756 B2
(45) Date of Patent: Feb. 2, 2016

(54) DISPLAY DEVICE

(71) Applicant: Samsung Display Co., Ltd., Yongin (KR)

(72) Inventors: Yong-Jun Choi, Asan-si (KR); Hyun Seok Ko, Yongin-si (KR); Po-Yun Park, Seoul (KR); Min Joo Lee, Seoul (KR); Youn Jin Jung, Daejeon (KR); Jung Hwan Cho, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 139 days.

(21) Appl. No.: 14/025,479

(22) Filed: Sep. 12, 2013

(65) Prior Publication Data

US 2014/0307003 A1 Oct. 16, 2014

(30) Foreign Application Priority Data

Apr. 11, 2013 (KR) ..... 10-2013-0039882

(51) Int. Cl.
*G09G 3/06* (2006.01)
*G09G 3/36* (2006.01)

(52) U.S. Cl.
CPC ..... *G09G 3/3677* (2013.01); *G09G 3/3648* (2013.01); *G09G 3/3614* (2013.01); *G09G 2320/0247* (2013.01); *G09G 2320/0626* (2013.01); *G09G 2320/0673* (2013.01); *G09G 2340/0428* (2013.01)

(58) Field of Classification Search
CPC . G09G 3/3648; G09G 3/3614; G09G 3/3677; G09G 2320/0247; G09G 2320/0626; G09G 2320/0673; G09G 2340/0428
See application file for complete search history.

(56) References Cited

U.S. PATENT DOCUMENTS

| | | | | |
|---|---|---|---|---|
| 6,219,016 | B1 * | 4/2001 | Lee | 345/87 |
| 6,727,878 | B2 * | 4/2004 | Okuzono et al. | 345/96 |
| 6,906,691 | B2 * | 6/2005 | Park et al. | 345/89 |
| 7,079,097 | B2 * | 7/2006 | Lee | 345/87 |
| 7,489,295 | B2 * | 2/2009 | Honbo | 345/102 |
| 7,580,032 | B2 * | 8/2009 | Jung et al. | 345/204 |
| 7,932,884 | B2 * | 4/2011 | Song et al. | 345/96 |
| 8,199,171 | B2 * | 6/2012 | Inoue et al. | 345/690 |
| 8,269,711 | B2 * | 9/2012 | Hsiao et al. | 345/99 |
| 8,446,395 | B2 * | 5/2013 | Song et al. | 345/209 |
| 8,570,314 | B2 * | 10/2013 | Hasegawa et al. | 345/213 |
| 8,593,391 | B2 * | 11/2013 | Okada et al. | 345/102 |
| 8,605,030 | B2 * | 12/2013 | Kang et al. | 345/102 |
| 8,610,697 | B2 * | 12/2013 | Hasegawa et al. | 345/208 |

(Continued)

FOREIGN PATENT DOCUMENTS

| | | |
|---|---|---|
| KR | 10-0381963 | 7/2002 |
| KR | 10-2008-0112500 | 12/2008 |

*Primary Examiner* — Lun-Yi Lao
*Assistant Examiner* — Peter D McLoone
(74) *Attorney, Agent, or Firm* — H.C. Park & Associates, PLC

(57) ABSTRACT

A display device includes: a display panel configured to display an image; and a signal controller configured to control signals to drive the display panel. The signal controller includes: an image data converter configured to convert image data of "m" bits into image data of "n" bits; a gray voltage generator configured to generate a gray voltage corresponding to the image data of "n" bits; a control signal generator configured to generate a gate control signal; and a luminance change controller configured to control a luminance change period of an image displayed via the display panel to be greater than or equal to one second.

20 Claims, 6 Drawing Sheets

(56) References Cited

U.S. PATENT DOCUMENTS

| | | | | |
|---|---|---|---|---|
| 8,941,633 | B2 * | 1/2015 | Hasegawa et al. | 345/208 |
| 2002/0080127 | A1 * | 6/2002 | Park et al. | 345/204 |
| 2004/0021625 | A1 * | 2/2004 | Lee | 345/87 |
| 2005/0242756 | A1 * | 11/2005 | Honbo | 315/403 |
| 2006/0221035 | A1 * | 10/2006 | Lee | 345/94 |
| 2007/0040795 | A1 * | 2/2007 | Lee et al. | 345/100 |
| 2007/0079192 | A1 * | 4/2007 | Kim et al. | 714/726 |
| 2007/0120794 | A1 * | 5/2007 | Shin et al. | 345/89 |
| 2008/0170024 | A1 * | 7/2008 | Song et al. | 345/96 |
| 2008/0291189 | A1 * | 11/2008 | Song et al. | 345/209 |
| 2009/0135304 | A1 * | 5/2009 | Inoue et al. | 348/712 |
| 2009/0295842 | A1 * | 12/2009 | Okada et al. | 345/690 |
| 2010/0085341 | A1 * | 4/2010 | Hasegawa et al. | 345/208 |
| 2010/0149167 | A1 * | 6/2010 | Hasegawa et al. | 345/213 |
| 2010/0295765 | A1 * | 11/2010 | Hsiao et al. | 345/98 |
| 2011/0169797 | A1 * | 7/2011 | Song et al. | 345/209 |
| 2012/0249617 | A1 * | 10/2012 | Ikawa | 345/691 |
| 2013/0038639 | A1 * | 2/2013 | Han | G09G 3/20 345/690 |
| 2013/0093803 | A1 * | 4/2013 | Saitoh | 345/690 |
| 2014/0022287 | A1 * | 1/2014 | Ahn | 345/690 |
| 2014/0055509 | A1 * | 2/2014 | Hasegawa et al. | 345/691 |
| 2014/0139568 | A1 * | 5/2014 | Yoshida et al. | 345/691 |
| 2014/0210697 | A1 * | 7/2014 | Hussain | G09G 5/10 345/84 |
| 2014/0218419 | A1 * | 8/2014 | Hasegawa et al. | 345/691 |
| 2014/0267464 | A1 * | 9/2014 | Takamaru et al. | 345/690 |
| 2014/0333605 | A1 * | 11/2014 | Hasegawa et al. | 345/212 |
| 2015/0062100 | A1 * | 3/2015 | Tanaka et al. | 345/204 |

* cited by examiner

DISPLAY DEVICE

CROSS-REFERENCE TO RELATED APPLICATION

This application claims priority from and the benefit of Korean Patent Application No. 10-2013-0039882, filed on Apr. 11, 2013, which is incorporated by reference for all purposes as if set forth herein.

BACKGROUND

1. Field

Exemplary embodiments relate to display technology, and, more particularly, to a display device configured to decrease flicker.

2. Discussion

Conventional liquid crystal displays typically include two display panels on which field generating electrodes, such as a pixel electrode and a common electrode, are formed, and a liquid crystal layer disposed therebetween. These liquid crystal displays are configured to display an image by, for example, applying a voltage to one or more of the field generating electrodes to generate an electric field in the liquid crystal layer, which controls the direction(s) of liquid crystal molecules of the liquid crystal layer, as well as the polarization of incident light passing therethrough.

To prevent (or otherwise reduced) deterioration of the liquid crystal layer caused, at least in part, by the application of a one-directional electric field to the liquid crystal layer for a relatively long duration, the polarity of a data voltage and/or a common voltage may be reversed for each frame, each row, and/or each pixel. It is noted, however, that driving a display device in such a manner may cause, at least in part, flicker in an associated screen presentation. That is, the inversion driving scheme of periodically inverting the polarity of the data voltage and/or common voltage between a positive polarity and a negative polarity may cause, at least in part, flicker in an associated screen presentation.

The above information disclosed in this Background section is only for enhancement of understanding of the background of the invention, and, therefore, it may contain information that does not form the prior art that is already known in this country to a person of ordinary skill in the art.

SUMMARY

Exemplary embodiments provide a display device configured to prevent (or otherwise decrease) flicker.

Additional aspects will be set forth in the detailed description which follows and, in part, will be apparent from the disclosure, or may be learned by practice of the invention.

According to exemplary embodiments, a display device includes: a display panel configured to display an image; and a signal controller configured to control signals to drive the display panel. The signal controller includes: an image data converter configured to convert image data of "m" bits into image data of "n" bits; a gray voltage generator configured to generate a gray voltage corresponding to the image data of "n" bits; a control signal generator configured to generate a gate control signal; and a luminance change controller configured to control a luminance change period of an image displayed via the display panel to be greater than or equal to one second.

According to exemplary embodiments, the display device may prevent (or otherwise decrease) the conspicuousness of flicker on an associated screen presentation by extending a luminance change period of an image to be greater than or equal to one second.

The foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION OF THE ILLUSTRATED EMBODIMENTS

Figure 1:
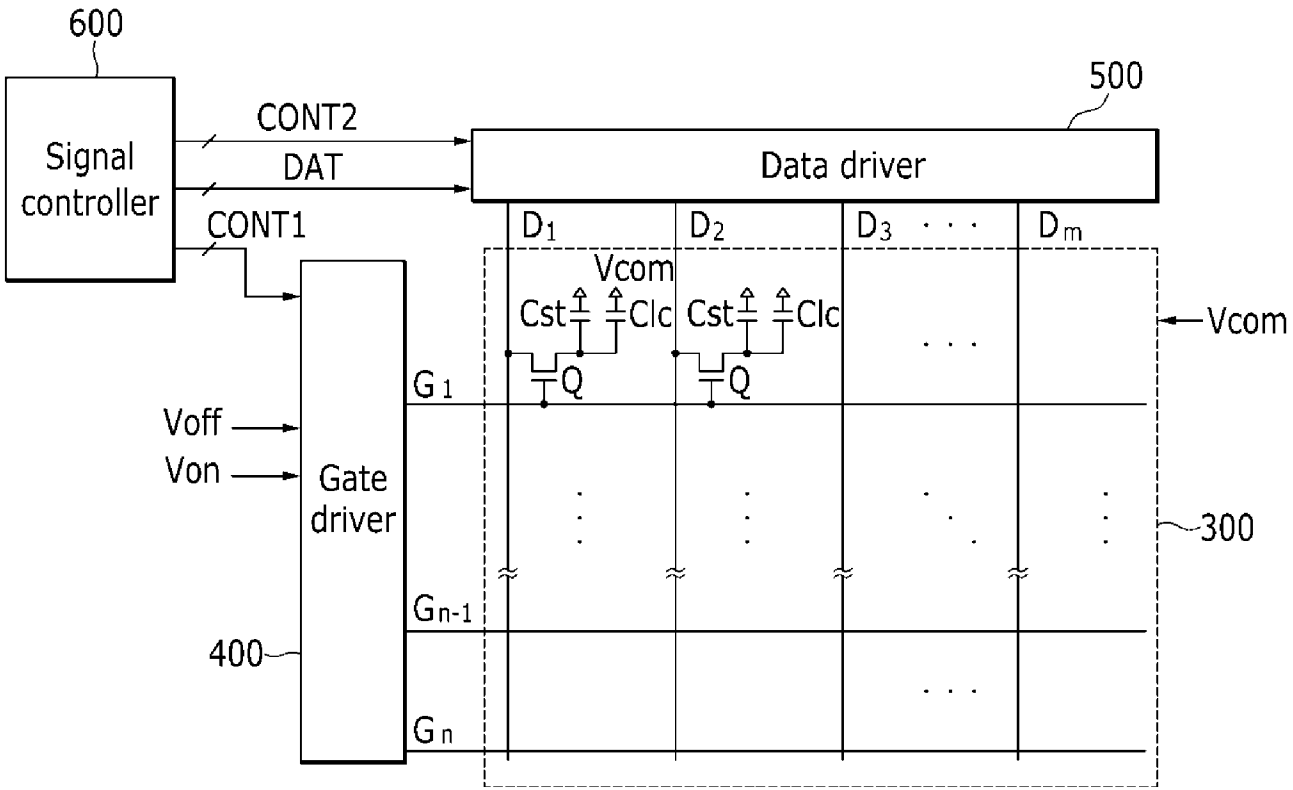
FIG. 1 is a block diagram of a display device, according to exemplary embodiments.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/ or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

Although exemplary embodiments are described in association with liquid crystal display (LCD) devices, it is contemplated that exemplary embodiments may be utilized in association with other or equivalent display devices, such as various self-emissive and/or non-self-emissive display technologies. For instance, self-emissive display devices may include organic light emitting displays (OLED), plasma display panels (PDP), etc., whereas non-self-emissive display devices may include electroluminescent (EL) displays, electrophoretic displays (EPD), electrowetting displays (EWD), etc.

FIG. 1 is a block diagram of a display device, according to exemplary embodiments.

As seen in FIG. 1, the display device may include a display panel 300 configured to display an image, a gate driver 400, a data driver 500, and a signal controller 600 configured to control signals for driving the display panel 300 via the gate driver 400 and the data driver 500. Although specific reference will be made to this implementation, it is also contemplated that the display device may embody many forms and include multiple and/or alternative components. For example, it is contemplated that the components of the display device may be combined, located in separate structures, and/or separate locations.

According to exemplary embodiments, the display panel 300 includes a plurality of gate lines G1 to Gn and a plurality of data lines D1 to Dm, where "n" and "m" are natural numbers. The plurality of gate lines G1 to Gn extend in a first (e.g., horizontal) direction, and the plurality of data lines D1 to Dm extend in a second (e.g., vertical) direction and intersect the plurality of gate lines G1 to Gn.

In exemplary embodiments, a gate line (e.g., gate line G1) and a data line (e.g., data line D1) are connected to a pixel, and a pixel includes a switching element Q connected to the gate line and the data line. A control terminal of the switching element Q is connected to, for example, the gate line, an input terminal is connected to, for instance, the data line, and an output terminal is connected to, for example, a liquid crystal capacitor $C_{lc}$, and a storage capacitor $C_{st}$.

It is noted that one terminal of the liquid crystal capacitor $C_{lc}$, may be connected to the output terminal of the switching element Q, and another terminal may be connected to a common electrode, which may be supplied with a common voltage Vcom. It is also noted that a pixel electrode (not shown) formed in a display area of the display panel 300 may be connected to the switching element Q.

According to exemplary embodiments, electric fields may be formed between the pixel electrodes and the common electrode(s), by data voltages applied to the pixel electrodes through the data lines D1 to Dm and the common voltages Vcom applied to the common electrodes. In this manner, the pixel electrodes and the common electrodes may be formed on the same substrate, and the electric field formed between the pixel electrodes and the common electrodes may be a "horizontal" electric field. It is contemplated, however, that any suitable electric field may be formed between the pixel electrodes and the common electrodes, such as a vertical electric field, etc.

The signal controller 600 is configured to process, for example, input image data and a control signal in accordance with an operation condition of the liquid crystal display panel 300. It is noted that the signal controller 600 is described in more detail in association with FIGS. 2 and 5. In general, however, the signal controller 600 may be configured to receive the input image data and the control signal of the input image data from any suitable source, such as an external source. The received signals may include, for example, a vertical synchronization signal Vsync, a horizontal synchronization signal Hsync, a main clock signal MCLK, a data enable signal DE, etc. To this end, the signal controller 600 may be configured to generate and output a first (e.g., gate) control signal CONT1 and a second (e.g., data) control signal CONT2, as well as, for instance, image data DAT.

The gate control signal CONT1 may include a vertical synchronization start signal STV (not shown) configured to instruct (or otherwise control) an output start of a gate-on pulse (e.g., a high section of a gate signal GS), a gate clock signal CPV (not illustrated) configured to control an output time of the gate-one pulse, and the like.

The data control signal CONT2 may include a horizontal synchronization start signal STH (not shown) configured to instruct (or otherwise control) an input start of the image data DAT, and a load signal TP (not illustrated) configured to instruct (or otherwise control) application of a corresponding data voltage to the data lines D1 to Dm, and the like.

The gate driver 400 is configured to drive the gate lines G1 to Gn, and the data driver 500 is configured to drive the data lines D1 to Dm. As such, the plurality of gate lines G1 to Gn may be connected to the gate driver 400. To this end, the gate driver 400 may apply a gate-on voltage Von and a gate-off voltage Voff to the gate lines G1 to Gn according to the gate control signal CONT1 applied from the signal controller 600. Further, the plurality of data lines D1 to Dm may be connected to the data driver 500. In this manner, the data voltage(s) may be applied to the pixels based on the application of the gate-on voltage Von and gate-off voltage Voff by the gate driver 400.

According to exemplary embodiments, the signal controller 600, the gate driver 400, the data driver 500, and/or one or more components thereof may be implemented via one or more general purpose and/or special purpose components, such as one or more discrete circuits, digital signal processing chips, integrated circuits, application specific integrated circuits, microprocessors, processors, programmable arrays, field programmable arrays, instruction set processors, and/or the like.

In exemplary embodiments, the processes described herein may be implemented via software, hardware (e.g., general processor, Digital Signal Processing (DSP) chip, an Application Specific Integrated Circuit (ASIC), Field Programmable Gate Arrays (FPGAs), etc.), firmware, or a combination thereof. In this manner, the display device may include or otherwise be associated with one or more memories (not shown) including code (e.g., instructions) configured to cause the display device to perform one or more of the features/functions/processes described herein.

The memories may be any medium that participates in providing code/instructions to the one or more software, hardware, and/or firmware for execution. Such memories may take many forms, including but not limited to non-volatile media, volatile media, and transmission media. Non-volatile media include, for example, optical or magnetic disks. Volatile media include dynamic memory. Transmission media include coaxial cables, copper wire and fiber optics. Transmission media can also take the form of acoustic, optical, or electromagnetic waves. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, and EPROM, a FLASH-EPROM, any other memory chip or cartridge, a carrier wave, or any other medium from which a computer can read.

According to exemplary embodiments, the display panel 300 may include two substrates (not shown) bonded to and facing each other. The gate driver 400 may be formed to attach to or be disposed on one side edge of the display panel 300. Further, the gate driver 400 may be formed as part of the display panel 300 together with the gate lines G1 to Gn, the data lines D1 to Dm, and the switching elements Q. That is, the data driver 500 and/or the gate driver 400 may be formed (e.g., simultaneously formed) in a process of forming the gate lines G1 to Gn, the data lines D1 to Dm, and the switching elements Q. It is contemplated, however, that the gate driver 400 and/or the data driver 500 may be coupled to the display panel 300 via, for instance, one or more printed circuit boards (PCB) or other electronic package assemblies, e.g., through-hole, surface mount, chip carrier, pin grid array, flat packages, small outline packages, chip-scale packages, ball grid array, flip chip, etc.

The plurality of data lines D1 to Dm of the display panel 300 may be connected to the data driver 500. In this manner, the data driver 500 may be configured to receive the data control signal CONT2, the image data DAT, and a gray voltage (not shown) from the signal controller 600. The data driver 500 may be further configured to convert the image data DAT to a data voltage using a gray voltage, and transfer (or otherwise apply) the converted data voltage to the data lines D1 to Dm.

Figure 2:
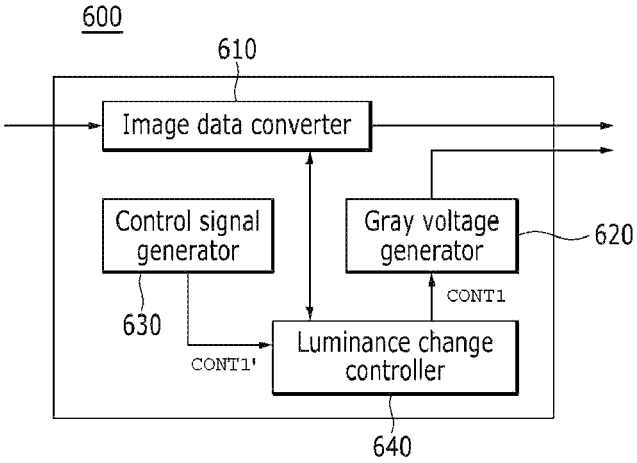
FIG. 2 is a block diagram of a signal controller of the display device of FIG. 1, according to exemplary embodiments.

FIG. 2 is a block diagram of a signal controller of the display device of FIG. 1, according to exemplary embodiments.

The signal controller 600 may, according to exemplary embodiments, include an image data converter 610 to convert image data, a gray voltage generator 620 to generate a gray voltage corresponding to the image data, a control signal generator 630 to generate a gate control signal, and a luminance change controller 640 to control a luminance change period of an image displayed via the display panel 300.

The image data converter 610 is configured to convert image data of "m" bits to image data of "n" bits. It is noted that "n" may be of a larger value than "m." That is, the image data converter 610 may extend the number of grays of the image data DAT by receiving image data of a lower bit count and change the image data of the lower bit count to image data DAT of a higher bit count.

For example, "m" bits may be 6 bits, and "n" bits may be 8 bits. The image data of 6 bits is formed of 64 grays including gray value 0 to gray value 63. The image data of 8 bits is formed of 256 grays including gray value 0 to gray value 255. When the image data of 6 bits is converted to the image data of 8 bits, gray value 0 in the image data of 6 bits may be converted to gray value 0 in the image data of 8 bits, and gray value 2 in the image data of 6 bits may be converted to gray value 6 in the image data of 8 bits. Gray value 1 positioned between gray value 0 and gray value 2 in the image data of 6 bits may be converted to any one gray value among gray value 1 to gray value 5 in the image data of 8 bits. In a similar manner, the other gray scale values between the two bit counts may be converted to generate image data DAT of a higher bit count.

According to exemplary embodiments, the gray voltage generator 620 is configured to generate a gray voltage corresponding to the image data. The gray voltage generator 620 is configured to generate a gray voltage based on the number of bits of image data that was converted by the image data converter 610. That is, the gray voltage generator 620 may generate gray voltages corresponding to the image data of "n" bits.

For example, when the image data converter 610 converts image data of 6 bits to image data of 8 bits, the gray voltage generator 620 may generate a gray voltage corresponding to the image data of 8 bits. That is, the gray voltage generator 620 may generate the gray voltages corresponding to grays ranging from gray value 0 to gray value 255.

The gray voltage generator 620 may generate a gamma corrected gray voltage. A gamma correction coefficient used in the gamma correction may be changed (or otherwise modified) according to a characteristic of the display panel 300. It is also contemplated that the gamma correction coefficient may be adjusted by a manufacturer or user of the display device.

The control signal generator 630 is configured to generate the gate control signal including the vertical synchronization start signal STV, the gate clock signal CPV, and the like. The gate control signal generated by the control signal generator 630 may be transferred (or otherwise provided) to the gate driver 400 through the luminance change controller 640. The gate driver 400 is configured to apply the gate-on voltage and the gate-off voltage to the gate lines G1 to Gn of the display panel 300 using the gate control signal(s).

According to exemplary embodiments, a width (or duration) of the gate-on voltage (or voltage pulse) may be determined according to a width (or duration) of the gate clock signal CPV corresponding to the gate-on voltage. For example, a width of the gate-on voltage may be the same as a width of the portion of the gate clock signal CPV corresponding to the gate-on voltage.

The control signal generator 630 may further generate a gate-on enable signal OE as the gate control signal. The gate driver 400 may apply the gate-on voltage and the gate-off voltage to the gate lines G1 to Gn of the display panel 300 further using the gate-on enable signal OE. In this manner, the width of the gate-on voltage may be determined according to the gate clock signal CPV and the gate-on enable signal OE. For example, the width of the gate-on voltage may be from a time at which the gate clock signal CPV is applied to a time at which the gate-on enable signal OE is applied. Accordingly, as the time at which the gate-on enable signal OE is applied becomes later, the width of the gate-on voltage increases.

The luminance change controller 640 may control a luminance change period of a pixel of the display panel 300 to be equal to or greater than one second. The luminance change controller 640 may control a luminance change period by making a control so that the image data converter 610 adjusts the image data, making a control so that the gray voltage generator 620 adjusts a gamma correction coefficient, or adjusting the gate control signal applied from the control signal generator 630. A method of controlling the luminance change period will be described in more detail below.

The period of the luminance change controlled by the luminance change controller 640 will be described below with reference to FIGS. 3 and 4.

Figure 3:
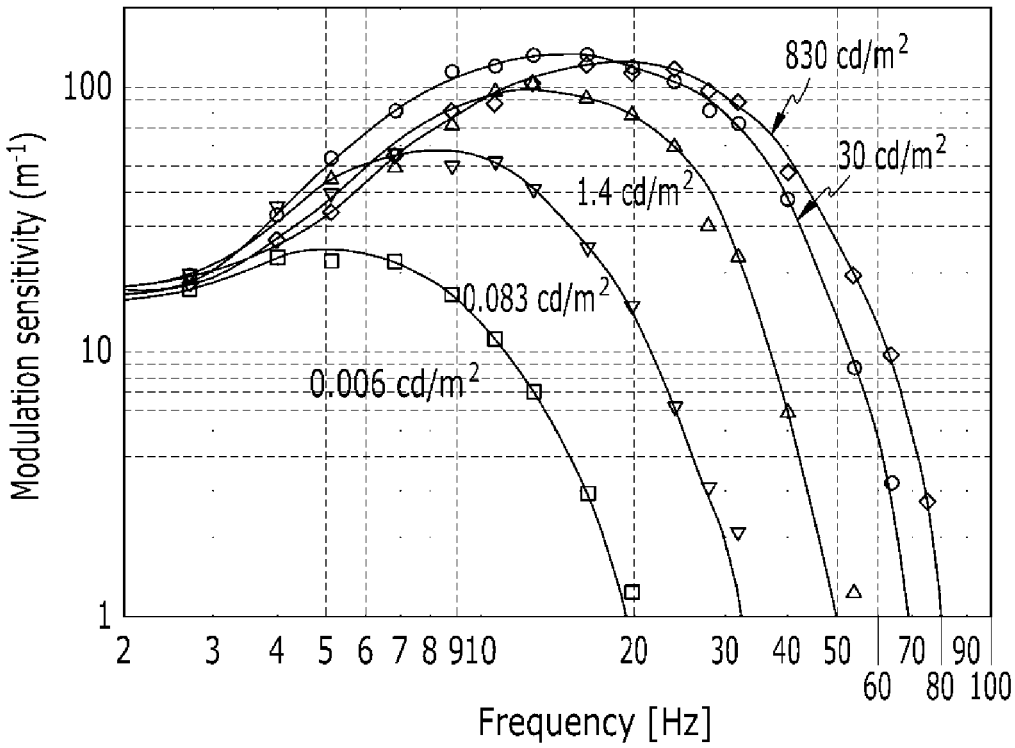
FIG. 3 is a graph comparing threshold modulation sensitivity with frequency, according to exemplary embodiments.

FIG. 3 is a graph comparing threshold modulation sensitivity with a frequency, according to exemplary embodiments. FIG. 4 is a graph comparing a luminance change with a time for the display device of FIG. 1, according to exemplary embodiments.

Referring to FIG. 3, it can be appreciated that for a frequency of about 10 Hz or more, as the frequency decreases, sensitivity for the luminance change tends to increase. For example, when the frequency is 60 Hz and the luminance is 30 cd/m$^2$, a luminance change of about ⅕ or more of an absolute luminance is recognized. When the frequency is 10 Hz and the luminance is 30 cd/m$^2$, a luminance change of about 1/100 or more of the absolute luminance is recognized. That is, as the frequency decreases, the luminance change tends to be well recognized.

As can be appreciated from the graph of FIG. 3, as the frequency decreases from about 10 Hz or lower, sensitivity of the luminance change tends to decrease. For example, when the frequency is 10 Hz and the luminance is 30 cd/m$^2$, a luminance change of about 1/100 or more of the absolute luminance is recognized. When the frequency is 2 Hz and the luminance is 30 cd/m$^2$, a luminance change of about 1/10 or more of the absolute luminance is recognized. That is, as the frequency decreases, the luminance change is less recognized.

According to exemplary embodiments, flicker may be decreased by making the driving frequency of the display device driven with a high frequency, such as 30 Hz, 60 Hz, and 120 Hz, to be about 1 Hz or lower, which also prevents (or otherwise reduces) the luminance change from being well recognized.

Figure 4:
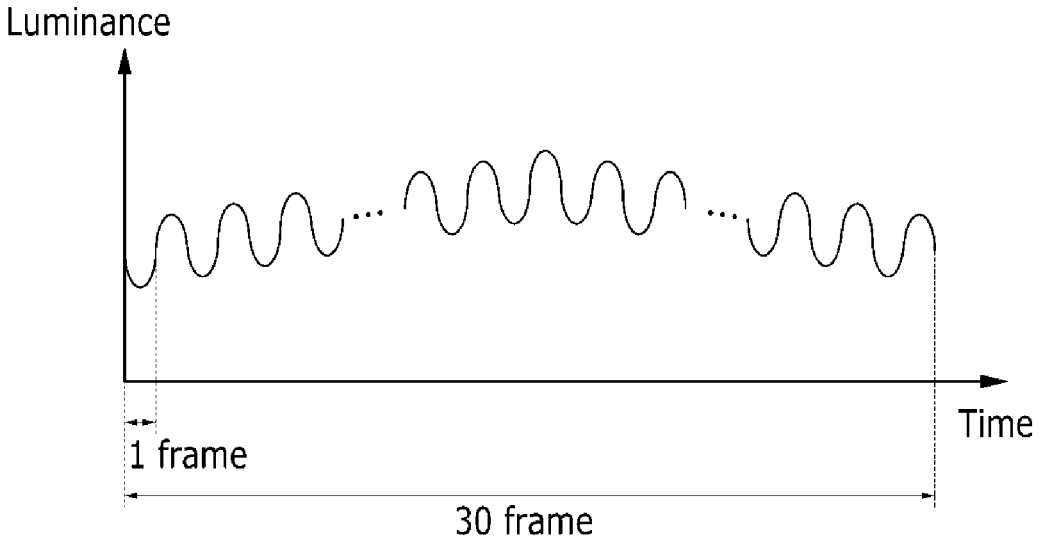
FIG. 4 is a graph comparing a luminance change with time for the display device of FIG. 1, according to exemplary embodiments.

For example, as seen in FIG. 4, high luminance and low luminance are repeated at a period of two frames in a liquid crystal display driven at 30 Hz. In this manner, the luminance gradually increases from the first frame to the fifteenth frame, and the luminance gradually decreases from the fifteenth frame to the thirtieth frame. That is, the low luminance of the third frame has a smaller value than the low luminance of the first frame, and the low luminance of the fifth frame has a smaller value than the low luminance of the third frame. In this manner, the "gradual" increase/decrease of the luminance may be steady and, thereby, not abrupt, e.g., the change may be a regular, continuous degree of change. Further, the low luminance of the seventeenth frame has a smaller value than the low luminance of the fifteenth frame, and low luminance of the nineteenth frame has a smaller value than the low luminance of the seventeenth frame. In this manner, a difference of the low luminance of the first frame and the low luminance of the third frame is set to have a small, inconspicuous difference. That is, it seems that the pattern is repeated at a period of two frames in a position of an observer, but the luminance change period is controlled so that the luminance change is substantially generated at a period of one second.

According to exemplary embodiments, the luminance change period of the display device driven with the high frequency is controlled to be one second or longer, so that the flicker may be decreased.

A method of controlling the aforementioned luminance change period will be described in more detail below with reference to FIGS. 1 and 2.

First, a method of controlling the luminance change period by adjusting image data by the image data converter 610 will be described below.

The image data converter 610 may be configured to convert image data of "m" bits to image data of "n" bits and then add compensation data to the converted image data of "n" bits to output the added data to the data driver 500. As such, the luminance change controller 640 may be configured to set the luminance change period to transfer the set luminance change period to the image data converter 610, and the image data converter 610 may set the compensation data to have values gradually changing within the luminance change period. It is noted that the compensation data may include a value which gradually increases and gradually decreases within the luminance change period.

According to exemplary embodiments, the image data converter 610 may change the data voltage supplied to the liquid crystal panel 300 by changing image data of an image originally desired to be displayed and outputting the changed image data. As such, the luminance of the image displayed on the liquid crystal panel 300 is changed. In this manner, a difference between the change luminance value and the luminance value of the image originally desired to be displayed may be set to have a small, inconspicuous difference in value.

For example, the compensation data in the first frame and the second frame may be formed of gray value 1, and the compensation data in the third frame and the fourth frame may be formed of gray value 2. That is, the compensation data may be formed of values increasing by one gray value for each two frames from the first frame to the fifteenth frame. Further, the compensation data may be formed of values decreasing by one for each two frames from the sixteenth frame to the thirtieth frame.

The values of the aforementioned compensation data are illustrative, and may be variously changed. The value of the compensation data may be set to have any suitable size in which the change in luminance is inconspicuous to the eyes of an observer.

For example, the compensation data may be formed of values increasing by one gray for every three frames and decreasing by one gray for every three frames. Further, the compensation data may be formed of values increasing by one gray for every frame and decreasing by one gray for every frame. Further, the compensation data may be formed of values increasing by two grays for every two frames and decreasing by two grays for every two frames.

Further, the luminance change period may be further extended. For example, the compensation data may be formed of values increasing by one gray for every two frames from the first frame to the thirtieth frame, and values decreasing by one gray for every two frames from the thirty-first frame to the sixtieth frame.

Although the compensation data formed of gray values gradually increasing and gradually decreasing within the luminance change period has been previously described, exemplary embodiments are not limited thereto or thereby. The compensation data may be formed of gray values gradually decreasing and gradually increasing within the luminance change period.

A method of controlling the luminance change period by adjusting the gamma correction coefficient by the gray voltage generator 620 will be described below.

According to exemplary embodiments, the gray voltage generator 620 may generate a comma corrected gray voltage so as to correspond to the image data of "n" bits. In this manner, the luminance change controller 640 may set the luminance change period and transfer the set luminance change period to the gray voltage generator 620. As such, the gray voltage generator 620 may set the gamma correction coefficient to have value gradually changing within the luminance change period. It is noted that the gamma correction coefficient may have values gradually increasing and gradually decreasing within the luminance change period.

The gray voltage generator 620 may change the data voltage supplied to the liquid crystal panel 300 and change luminance of the image displayed on the liquid crystal panel 300 according to the change in the data voltage by changing the gamma correction coefficient. In this manner, a difference between the changed luminance value and the luminance value before the change of the gamma correction coefficient may be set to have a small, inconspicuous difference in value.

For example, the gamma correction coefficient may be 2.2 gamma in the first frame, the gamma correction coefficient may be 2.201 gamma in the second frame, and the gamma correction coefficient may be 2.202 gamma in the third frame. That is, the gamma correction coefficient may be formed of values increasing by 0.001 gamma for each frame from the first frame to the fifteenth frame. Further, the gamma correction coefficient may be formed of the values decreasing by 0.001 gamma for each frame from the sixteenth frame to the thirtieth frame.

The aforementioned values of the gamma correction coefficient are illustrative, and may be variously changed. That is, the value of the gamma correction coefficient may be set to have any suitable size in which the luminance change is not conspicuous to the eyes of an observer.

For example, the compensation data may be formed of values increasing by 0.001 gamma for every two frames and decreasing by 0.001 gamma for every two frames. Further, the compensation data may be formed of values increasing by 0.001 gamma for every three frames and decreasing by 0.001 gamma for every three frames. Further, the compensation data may be formed of values increasing by 0.002 gamma for each frame and decreasing by 0.002 gamma for each frame.

Further, the luminance change period may be further extended. For example, the gamma correction coefficient may be formed of values increasing by 0.001 gamma for each frame from the first frame to the thirtieth frame, and the values decreasing by 0.001 gamma for each frame from the thirty first frame to the sixtieth frame.

Although the gamma correction coefficient has been described in association with values gradually increasing and gradually decreasing within the luminance change period, exemplary embodiments are not limited thereto or thereby. The gamma correction coefficient may be formed of values gradually decreasing and gradually increasing within the luminance change period.

A method of controlling the luminance change period by adjusting the gate control signal received from the control signal generator 630 by the luminance change controller 640 will be described below with reference to FIGS. 5 and 6.

Figure 5:
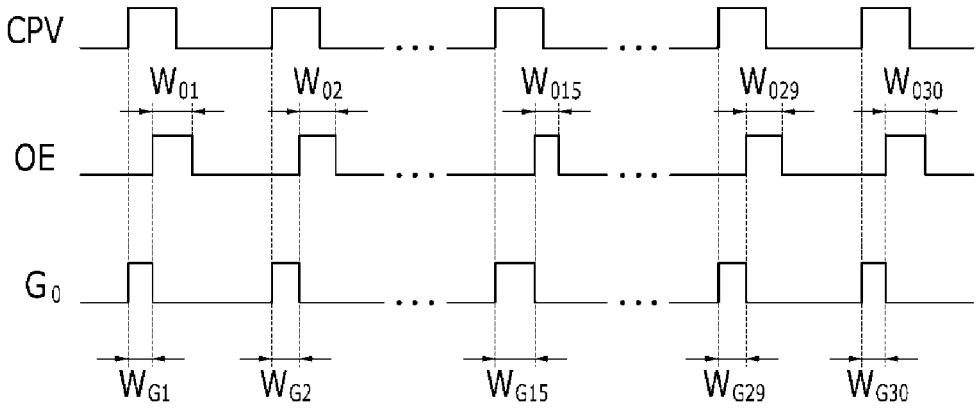
FIGS. 5 and 6 are respective timing diagrams of a gate control signal and a gate signal, according to exemplary embodiments.
Figure 6:
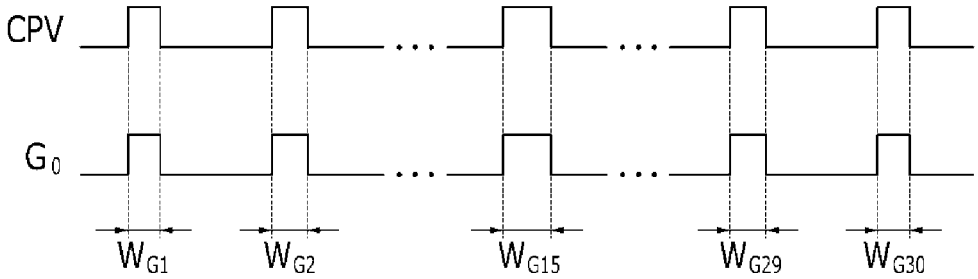

FIGS. 5 and 6 are respective timing diagrams of a gate control signal and the gate signal, according to exemplary embodiments.

First, a case where the width of the gate-on voltage is determined according to the gate clock signal CPV and the gate-on enable signal OE as illustrated in FIG. 5 will be described.

According to exemplary embodiments, the control signal generator 630 is configured to generate the gate clock signal CPV and the gate-on enable signal OE and output the generated gate clock signal CPV and gate-on enable signal OE to the luminance change controller 640. The luminance change controller 640 is configured to set the luminance change period, and gradually change the width of the gate-on enable signal OE within the luminance change period. It is noted that the width of the gate-on enable signal OE may be set to gradually decrease and gradually increase within the luminance change period.

In exemplary embodiments, the luminance change controller 640 is configured to change the width of the gate-on voltage forming the gate signal $G_0$ and change the pixel voltage charged in a pixel of the liquid crystal display panel 300 by changing the width of the gate-on enable signal OE. As such, the luminance of the image displayed on the liquid crystal display panel 300 is changed. In this manner, a difference between the change luminance value and a luminance value of the image originally desired to be displayed may be set to have a small, inconspicuous value.

For example, a width $W_{02}$ of the gate-on enable signal OE in the second frame may be set to be smaller than a width $W_{01}$ of the gate-on enable signal OE in the first frame. That is, the width of the gate-on enable signal OE may be set to gradually decrease for each frame from the first frame to the fifteenth frame. In this manner, the width of the gate-on voltage is gradually increasing for each frame from the first frame to the fifteenth frame, and the pixel voltage charged in the pixel also gradually increases. Further, the width of the gate-on enable signal OE may be set to gradually increase for each frame from the sixteenth frame to the thirtieth frame. In this manner, the width of the gate-on voltage gradually decreases for each frame from the sixteenth frame to the thirteenth frame, and the pixel voltage charged in the pixel also gradually decreases.

Although the width of the gate-on enable signal OE being changed for each frame has been described, exemplary embodiments are not limited thereto or thereby. The width of the gate-on enable signal OE may be changed at a period of two frames or three frames. Further, a quantity of the change in the width of the gate-on enable signal OE may be variously set. The change period and the quantity of change of the width of the gate-on enable signal OE may be set to have any suitable size in which the change in the luminance according to the change in the gate-on enable signal OE is not conspicuous to the eyes of an observer. Further, the luminance change period may be further extended. For example, the width of the gate-on enable signal OE may gradually increase for each frame from the first frame to the thirtieth frame, and may gradually decreases for each frame from the thirty-first frame to the sixtieth frame.

Although the width of the gate-one enable signal OE gradually decreasing and gradually increasing within the luminance change period has been described, exemplary embodiments are not limited thereto or thereby. The width of the gate-one enable signal OE may be set to gradually increase and gradually decrease within the luminance change period.

Next, a case where the width of the gate-on voltage is determined according to the gate clock signal CPV as illustrated in FIG. 6 will be described.

According to exemplary embodiments, the control signal generator 630 is configured to generate the gate clock signal CPV and output the generated gate clock signal CPV to the luminance change controller 640. The luminance change controller 640 is configured to set the luminance change period, and gradually change the width of the gate clock signal CPV within the luminance change period. It is noted that the width of the gate clock signal CPV may be set to gradually increase and gradually decrease within the luminance change period.

The luminance change controller 640 may be configured to change the width of the gate-on voltage forming the gate signal $G_O$ and change the pixel voltage charged in a pixel of the liquid crystal display panel 300 by changing the width of the gate clock signal CPV. As such, the luminance of the image displayed on the liquid crystal display panel 300 may be changed. In this manner, a difference between the changed luminance value and the luminance value of the image originally desired to be displayed may be set to have a small, inconspicuous different in value.

For example, the width of the gate clock signal CPV in the second frame may be set to be larger than the width of the gate clock signal CPV in the first frame. That is, the width of the gate clock signal CPV may be set to gradually increase for each frame from the first frame to the fifteenth frame. As such, the width of the gate-on voltage gradually increases for each frame from the first frame to the fifteenth frame, and the pixel voltage charged in the pixel also gradually increases. Further, the width of the gate clock signal CPV may be set to gradually decrease for each frame from the sixteenth frame to the thirtieth frame. In this manner, the width of the gate-on voltage gradually decreases for each frame from the sixteenth frame to the thirtieth frame, and the pixel voltage charged in the pixel also gradually decreases.

Although the width of the gate clock signal CPV being changed for each frame has been described, exemplary embodiments are not limited thereto or thereby. The width of the gate clock signal CPV may be changed at a period of two frames or three frames. Further, a quantity of change in the width of the gate clock signal CPV may be variously set. The change period and the quantity of change of the width of the gate clock signal CPV may be set to have any suitable size in which the change in the luminance according to the change in the gate clock signal CPV is not conspicuous to the eyes of an observer. Further, the luminance change period may be further extended. For example, the width of the gate clock signal CPV may gradually increase for each frame from the first frame to the thirtieth frame, and may be gradually decrease for each frame from the thirty-first frame to the sixtieth frame.

Although the width of the gate clock signal CPV has been described as gradually increasing and decreasing within the luminance change period, exemplary embodiments are not limited thereto or thereby. The width of the gate clock signal CPV may be set to gradually decrease and gradually increase within the luminance change period.

The method of adjusting the image data, the method of adjusting the gamma correction coefficient, the method of adjusting the gate charging time, and the like have been described as the method of controlling the luminance change period. It is noted, however, that one of these methods among the plurality of methods for controlling the luminance change period in the display device according to exemplary embodiments may be used, or two or more methods may be used.

Next, a signal controller of the display device of FIG. 1 will be described in more detail below with reference to FIG. 7.

Figure 7:
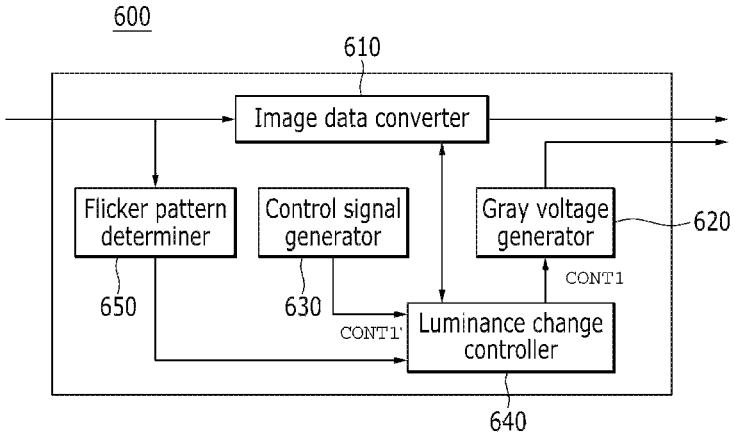
FIG. 7 is a block diagram of a signal controller of the display device of FIG. 1, according to exemplary embodiments.

FIG. 7 is a block diagram of a signal controller of the display device of FIG. 1, according to exemplary embodiments. It is noted that the signal controller illustrated in FIG. 7 is substantially the same as the signal controller shown in FIG. 2. Therefore, to avoid obscuring exemplary embodiments described herein, duplicative descriptions have been avoided and differences are expounded upon. It is noted that the main difference between the signal controllers of FIGS. 2 and 7, is that the signal controller of FIG. 7 further includes a flicker pattern determiner 650.

According to exemplary embodiments, the signal controller 600 includes an image data converter 610 configured to convert image data, a gray voltage generator 620 configured to generate a gray voltage corresponding to the image data, a control signal generator 630 configured to generate a gate control signal, a luminance change controller 640 configured to control a luminance change period of the image displayed in the display panel 300, and a flicker pattern determiner 650 configured to determine whether an image has a flicker pattern based on the reception of the image data. In other words, the flicker pattern determiner 650 is added to the signal controller 600 of FIG. 2.

According to exemplary embodiments, the flicker pattern determiner 650 is configured to receive image data of "m" bits applied, and determine whether the image displayed by the corresponding image data is an image in which flicker would be conspicuous to an observer. Flicker is well exhibited when the data voltage corresponding to the corresponding image data swings between a high voltage and a low voltage. For example, a dot pattern in which full-white and full-black are alternately displayed may be determined as a flicker pattern. The flicker pattern determiner 650 is configured to determine whether the image displayed by the input image data has the flicker pattern based on a determined reference, and transfer a result of the determination to the luminance change controller 640.

In exemplary embodiments, the luminance change controller 640 is configured to receive the determination from the flicker pattern determiner 650. In this manner, the luminance change controller 640 is configured to control the luminance change period based on the determination from the flicker pattern determiner 650. In this manner, the luminance change controller 640 may control the display device so that the luminance change period of the pixel applied to the display panel 300 is one second or longer. The luminance change controller 640 may control the luminance change period by making a control so that the image data converter 610 adjusts the image data, by making a control so that the gray voltage generator 620 adjusts the gamma correction coefficient, or adjusting the gate control signal applied from the control signal generator 630, such as previously described.

When the luminance change controller 640 receives a determination that the image displayed by the corresponding image data does not have a flicker pattern from the flicker pattern determiner 650, the luminance change controller 640 may be configured to not control (or otherwise modify) the luminance change period. When the image displayed by the corresponding image data has a flicker pattern, the luminance change period may not be separately controlled, which, thereby, reduces power consumption.

While certain exemplary embodiments and implementations have been described herein, other embodiments and modifications will be apparent from this description. Accordingly, the invention is not limited to such embodiments, but rather to the broader scope of the presented claims and various obvious modifications and equivalent arrangements.

What is claimed is:

1. A display device, comprising:

a display panel configured to display an image; and a signal controller configured to control signals to drive the display panel, wherein the signal controller comprises:

an image data converter configured to convert image data of "m" bits into image data of "n" bits;

a gray voltage generator configured to generate a gray voltage corresponding to the image data of "n" bits;

a control signal generator configured to generate a gate control signal; and a luminance change controller configured to control a luminance change period of an image displayed via the display panel to be greater than or equal to one second and to change a width of the gate control signal within the luminance change period.

2. The display device of claim 1, wherein:

the value of "n" is greater than the value of "m;"

the image data converter is configured to:

add compensation data to the image data of "n" bits; and output the added data; and the compensation data comprises values that change within the luminance change period.

3. The display device of claim 2, wherein the compensation data comprises values that gradually increase and gradually decrease within the luminance change period.

4. The display device of claim 1, wherein:

the gray voltage generator is configured to generate the gray voltage based on a gamma correction coefficient; and the gamma correction coefficient comprises values that change within the luminance change period.

5. The display device of claim 4, wherein the gamma correction coefficient comprises values that gradually increase and gradually decrease within the luminance change period.

6. The display device of claim 1, wherein:

the gate control signal comprises a gate clock signal;

the control signal generator is configured to output the gate clock signal to the luminance change controller; and the width is a width of the gate clock signal.

7. The display device of claim 6, wherein the width of the gate clock signal gradually increases and gradually decreases within the luminance change period.

8. The display device of claim 1, wherein:

the gate control signal comprises a gate clock signal and a gate-on enable signal;

the control signal generator is configured to output the gate clock signal and the gate-on enable signal to the luminance change controller; and the width is a width of the gate-on enable signal.

9. The display device of claim 8, wherein:

the width of the gate-on enable signal gradually increases and gradually decreases within the luminance change period.

10. The display device of claim 1, wherein:

the display panel comprises intersecting gate lines and data lines; and the display device further comprises:

a gate driver configured to apply a gate signal comprising a gate-on voltage and a gate-off voltage to the gate lines; and a data driver configured to apply the gray voltage corresponding to the image data of "n" bits to the data lines as a data voltage.

11. The display device of claim 10, wherein the width of the gate-on voltage changes within the luminance change period.

12. The display device of claim 11, wherein the width of the gate-on voltage gradually increases and gradually decreases within the luminance change period.

13. The display device of claim 1, further comprising a flicker pattern determiner configured to:

determine whether the image comprises a flicker pattern based on receiving the image data of "m" bits; and provide a result of the determination to the luminance change controller.

14. The display device of claim 13, wherein the luminance change controller is configured to control a luminance change period of the image displayed via the display panel to be greater than or equal to one second when the result indicates the flicker pattern exists.

15. The display device of claim 14, wherein the luminance change controller is configured to not control the luminance change period of the image displayed via the display panel when the result does not indicate the flicker pattern.

16. The display device of claim 1, wherein:

the image data converter is configured to:

add compensation data to the image data of "n" bits; and output the added data;

the gray voltage generator is configured to generate the gray voltage based on a gamma correction coefficient; and the compensation data and the gamma correction coefficient comprise values that change within the luminance change period.

17. The display device of claim 1, wherein the image data converter is configured to:

add compensation data to the image data of "n" bits; and output the added data;

the compensation data comprises values that change within the luminance change period;

the gate control signal comprises a gate clock signal;

the control signal generator is configured to output the gate clock signal to the luminance change controller; and the width is a width of the gate clock signal.

18. The display device of claim 1, wherein:

the gray voltage generator is configured to generate the gray voltage based on a gamma correction coefficient;

the gamma correction coefficient comprises values that change within the luminance change period;

the gate control signal comprises a gate clock signal;

the control signal generator is configured to: output the gate clock signal to the luminance change controller; and the width is a width of the gate clock signal.

19. The display device of claim 1, wherein:

the image data converter is configured to:

add compensation data to the image data of "n" bits; and output the added data;

the gray voltage generator is configured to generate the gray voltage based on a gamma correction coefficient;

the compensation data and the gamma correction coefficient comprise values that change within the luminance change period;

the gate control signal comprises a gate clock signal;

the control signal generator is configured to output the gate clock signal to the luminance change controller; and the width is a width of the gate clock signal.

20. The display device of claim 1, wherein:

the image data converter is configured to:

add compensation data to the image data of "n" bits; and output the added data;

the gray voltage generator is configured to generate the gray voltage based on a gamma correction coefficient;

the compensation data and the gamma correction coefficient comprise values that change within the luminance change period;

the gate control signal comprises a gate clock signal and a gate-on enable signal;

the control signal generator is configured to output the gate clock signal and the gate-on enable signal to the luminance change controller; and the width is a width of the gate-on enable signal.

* * * * *